United States Patent [19]

Dwire

[11] 4,368,466

[45] Jan. 11, 1983

[54] DISPLAY REFRESH MEMORY WITH VARIABLE LINE START ADDRESSING

[75] Inventor: Jerold D. Dwire, Round Rock, Tex.

[73] Assignee: International Business Machines Corporation, Armonk, N.Y.

[21] Appl. No.: 208,894

[22] Filed: Nov. 20, 1980

[51] Int. Cl.[3] ..... G09G 1/16

[52] U.S. Cl. ..... 340/799; 340/750; 364/900

[58] Field of Search ..... 340/798, 799, 724, 726

[56] References Cited

U.S. PATENT DOCUMENTS

| | | | |
|---|---|---|---|
| 3,683,359 | 8/1972 | Kleinschnitz . | |
| 3,827,041 | 7/1974 | Cook . | |
| 4,074,254 | 2/1978 | Belser et al. | 340/799 X |
| 4,117,469 | 9/1978 | Levine . | |
| 4,129,858 | 12/1978 | Hara . | |
| 4,203,107 | 5/1980 | Lovercheck | 340/799 |
| 4,249,172 | 2/1981 | Watkins et al. | 340/799 X |

OTHER PUBLICATIONS

D. M. Neal & H. C. Tanner; "Linking Algorithm for Display Memory;" I.B.M. Tech. Discl Bul., vol. 21, No. 11, Apr. 1979, pp. 4330–4331.

H. C. Tanner; "Linking Algorithm with Segmentation;" I.B.M. Tech. Discl. Bul., vol. 21, No. 11, Apr. 1979, pp. 4332–4333.

*Primary Examiner*—David L. Trafton

*Attorney, Agent, or Firm*—John L. Jackson

[57] ABSTRACT

A display refresh system wherein a RAM refresh buffer is tightly packed. Line start addresses in the buffer are determined by the line length such as eighty characters. With each of the lines in the refresh buffer being normally a binary number such as 128 characters in length the line start addresses are such that they do not coincide with the beginning of each line in the buffer. To assure packing they are interspersed each 80 positions sequentially within the buffer. A processor loads the address of each line start character into the pointer area of the refresh buffer. A line counter is used which counts the lines being displayed on the display. The RAM refresh buffer which contains the line start addresses and character data is first addressed by the line counter output to provide the line address. Since the refresh buffer is used as the line pointer register the output bus for pointer data and character data is common. Once the address of the first character in a line is read from the pointer area in the refresh buffer it is loaded into the refresh buffer address counter which then controls the sequential reading of characters in that line from the refresh buffer onto the data bus. Following the reading of each line the sequence is repeated, e.g., the line counter is incremented, its' count used to address the pointer register and the address contained in the pointer register loaded into the refresh buffer address counter.

15 Claims, 3 Drawing Figures

DISPLAY REFRESH MEMORY WITH VARIABLE LINE START ADDRESSING

DESCRIPTION

BACKGROUND OF THE INVENTION

1. Field of the Invention

This invention relates to display systems in general and more particularly, to a technique for packing and controlling a RAM refresh buffer for efficient utilization of the buffer both as storage of characters to be displayed as well as a source of the beginning point of each line of data to be displayed.

2. Description of the Prior Art

Numerous patents have addressed the general control of a refresh buffer to achieve efficient utilization of it in a display system.

U.S. Pat. No. 3,683,359 to Kleinschnitz, entitled "Video Display Terminal with Automatic Paging", filed Apr. 30, 1971, issued Aug. 8, 1972, is a display system which has a number of advantages over alternate types of systems. It utilizes a large memory and consequently can hold a large amount of data which can be displayed at one time. It provides a means for changing the portion of the memory to be displayed without destroying old data, and when used with a line end code, variable length lines can be stored using equivalent variable length memory slots. In addition, vertical scrolling in this system is simple. It, however, does have several disadvantages in that all of the lines displayed must be stored in sequence in the memory. That is, no alteration of line format can be accomplished without rewriting the memory. Additionally, there is a relatively large amount of logic hardware required and finally, any special data (menus, etc.) requires a dedicated sequential block of memory.

U.S. Pat. No. 4,117,469 to Levine, entitled "Computer Assisted Display Processor Having Memory Sharing by the Computer and Processor", filed Dec. 20, 1976, issued Sept. 26, 1978, is directed toward a display system which includes all of the advantages discussed in connection with the '359 patent. In addition, it has advantages such as any line(s) in memory can be displayed in any order desired without rewriting the memory. Also, new lines can be added and inserted anywhere on the display and the existing lines shifted in position without rewriting. Functions such as horizontal scrolling, line inserts and deletes can be done easily. Finally, multiple special data (menus) screens can be assembled from individual lines, i.e., common information can be displayed from the same memory slot for two or more memories. This patent does, however, have several disadvantages. First, it requires a dedicated microprocessor to handle the loading of the address counter in addition to the system processors time used to update data. Additionally, if the processor cannot respond in time one entire horizontal scan will be blank showing up as flicker on the CRT.

U.S. Pat. No. 4,129,858 to Toshitaka Hara, entitled "Partitioned Display Control System", filed Mar. 23, 1977, issued Dec. 12, 1978, contains several advantages of the ;359 patent and in addition, it requires minimal additional logic to provide several desirable features. However, it does have several disadvantages. That is, all the lines displayed must be in sequence in the memory and any special data (menus) requires a dedicated sequential block of memory. In addition, it can only select between screens of data and memory must be reserved for each position of every line whether used or not. Thus, the memory cannot be packed in this system.

U.S. Pat. No. 3,827,041 to Cook, entitled "Display Apparatus with Visual Segment Indicia", filed Aug. 14, 1973, issued July 30, 1974, has the advantage that it provides a large memory which holds more information than can be displayed at one time and there is provided means for changing the portion of the memory to be displayed without destroying old data. Again, however, it has the disadvantage that all lines displayed must be in sequence in the memory; large amounts of logic hardware are required; any special data (menu) requires a dedicated sequential block of memory; and there must be memory reserved for each position of every line whether the positions are used or not which results in inefficient use of the memory.

SUMMARY OF THE INVENTION

It is an object of the present invention to provide a display control system having all the advantages discussed in connection with the prior art patents. Further objects include the efficient packing of the refresh buffer, simplified control and the displaying of selected data independently of processor timing.

In summary, there is provided a system in which a RAM refresh buffer having, for instance, 2048 characters is used to drive a 25 line display. In this exemplary system in 25 lines on the display are 80 characters in length. Thus, 2000 characters are required for the display. Using a 2048 character random access memory, if the memory is packed closely in accordance with the present invention, 48 bytes can be dedicated to line start addresses or pointers and other tasks. In the preferred embodiment, the first 25 bytes are dedicated to storing the address of the first character of each of the 25 lines. These addresses are loaded by the processor. These pointers are addressed by a line counter which counts the lines as they are being displayed. The line counter is reset to zero at each vertical retrace time and clocked each time a complete character line has been displayed. The RAM refresh buffer is also addressed by an address counter. Whether the line counter or the address counter is the control for the RAM refresh buffer is controlled by a two to one multiplexer. Initially the line counter addresses the pointer area of the RAM and the first character address is loaded into the address counter. The multiplexer is then toggled and the RAM is then addressed by the address counter. The address counter is clocked each time a character is displayed. It is reset to zero during horizontal retrace, the line counter incremented and the two to one multiplexer toggled such that the contents of the line counter are again used as the first five low order address bits and the reset (all zeros) condition of the address counter is used for all the high order address bits.

DETAILED DESCRIPTION OF THE PREFERRED EMBODIMENT

Figure 1:
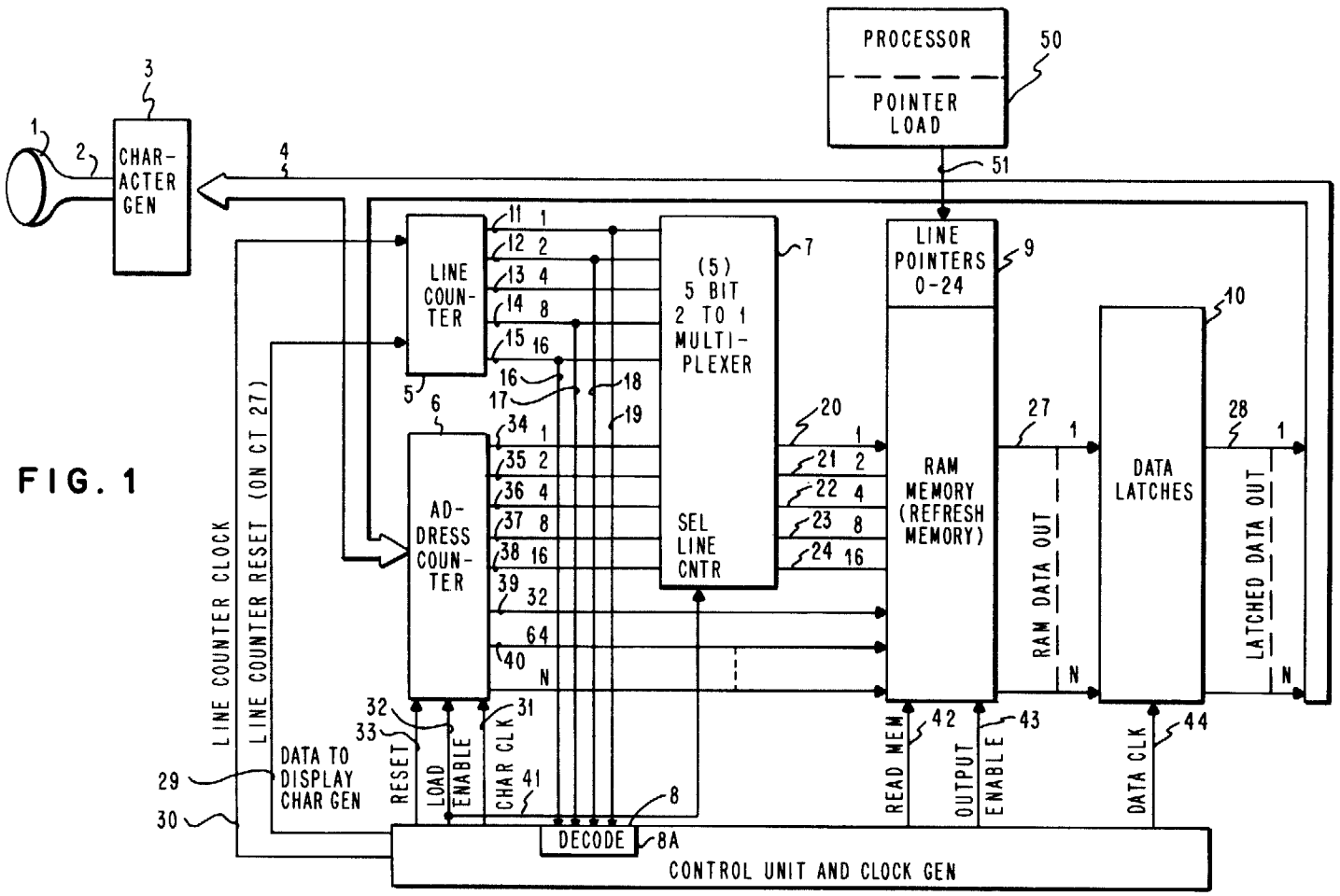
FIG. 1 is an overall systems diagram of the display system.

Refer first to the overall system diagram of FIG. 1. A CRT 1 receives character information along line 2 from a character generator 3. The character generator 3 receives data from bus 4 which data is output to it along line 28 from latches 10 upon application of a data clock signal on line 44. Latches 10 are loaded by means of lines 27 from a refresh buffer 9 when a read memory signal is applied along line 42. The RAM refresh buffer 9 is enabled under control of the timing and control 8 unit by application of an enable signal on line 42.

A processor/pointer load 50 is also connected along line 51 to the refresh memory 9. The unit 50 merely designates a means for loading the addresses of the first character in each line into the pointer area of the refresh buffer 9. It may be under processor control or it may be under operator-keyboard control. For purposes of the present invention its particular make-up is not important.

As further shown in FIG. 1 bus 4 is also connected to an address counter 6. The address counter 6 has outputs along lines 34 through 38 which are applied to a two to one multiplexer 7. The address counter 6 also has outputs applied along lines 39 and 40-n to the RAM refresh buffer 9. The address counter receives inputs along lines 33, 32 and 31 which are the reset enable, load enable and clock respectively. In addition to outputting the output enable to RAM refresh buffer along line 43 and data clock along line 44 to the latches the timing and control 8 also provides, along line 29 a reset to the line counter 5. This reset occurs when the timing and control detects that 27 complete lines of data having been output to the display. In addition, there is applied from the timing and control 8, along line 30, an SC4 signal which, as will herein be described, is used to indicate that the display system has scanned an individual line eight times. The reason for this, as will be obvious to those skilled in the art, is that in an interlaced display a number of scans per line is required.

The outputs from the line counter 5 are along lines 11 through 15 to the two to one multiplexer 7. As previously mentioned the two to one multiplexer then provides outputs along lines 20 through 24 to the RAM refresh buffer 9.

While not intended to be limiting, the system of FIG. 1 can be implemented in TTL. The TTL common part numbers for FIG. 1 are:

Line counter 5, 74LS393
Address Counter 6, 74LS163
Multiplexer 7, 74LS157
Data latches 10, 74LS174

The refresh memory 9 may be Motorola part number 211420.

Figure 2:
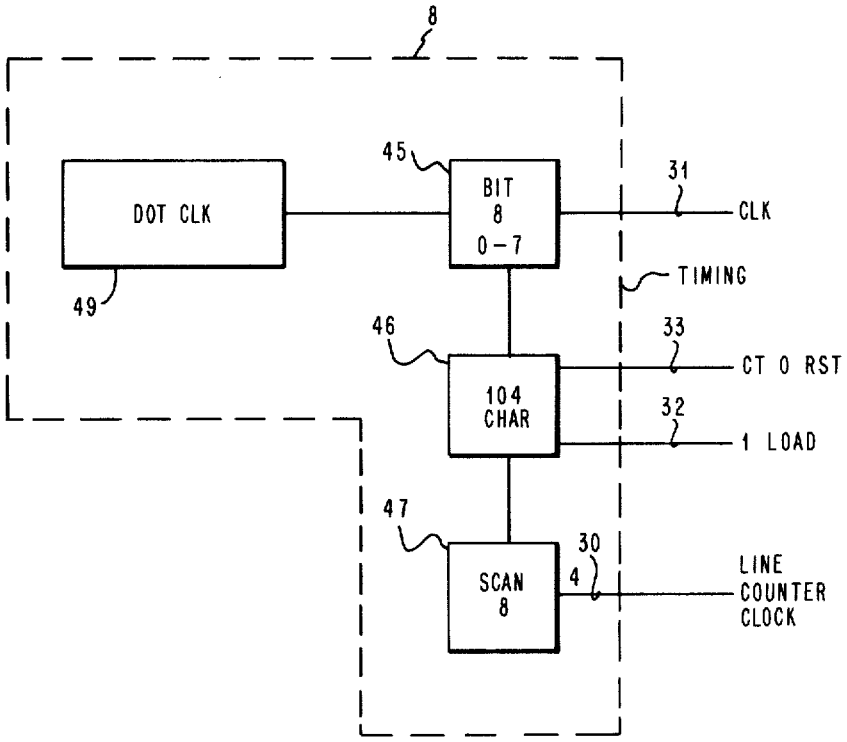
FIG. 2 is a schematic of the clocking employed in connection with FIG. 1.

Refer next to FIG. 2 for a brief description of the elementary timing of the system. As shown in FIG. 2 the timing generated in block 8 is originated from a dot clock 49 which is in essence a free running oscillator. The output of the dot clock is applied to an eight bit character dot counter which provides an output for each character (eight input clocks) which as shown is applied to line 31 which is applied to the address counter of FIG. 1. The other output from the 8 bit counter in FIG. 2 is applied to a 104 character counter 46. The 104 character counter 46 has three outputs. The first output is the counter zero output which is applied to line 33 of FIG. 1 to provide the reset signal to the address counter 6. The second output is at the 1 time to provide the load enable which is applied to line 32 in FIG. 1 to cause the address counter 6 to be loaded with the contents appearing on data bus 4. The final output from the 104 character register 46 occurs when a complete line has been scanned and this is applied to the scan 8 counter 47. The scan 8 counter 47 is merely an 8 count counter and it is used in this embodiment of the invention to indicate when 8 scans of a single line have occurred and when this has happened, the scan 4 line, which is labelled 30, and is applied to the line counter 5 of FIG. 1 is brought low.

Figure 3:
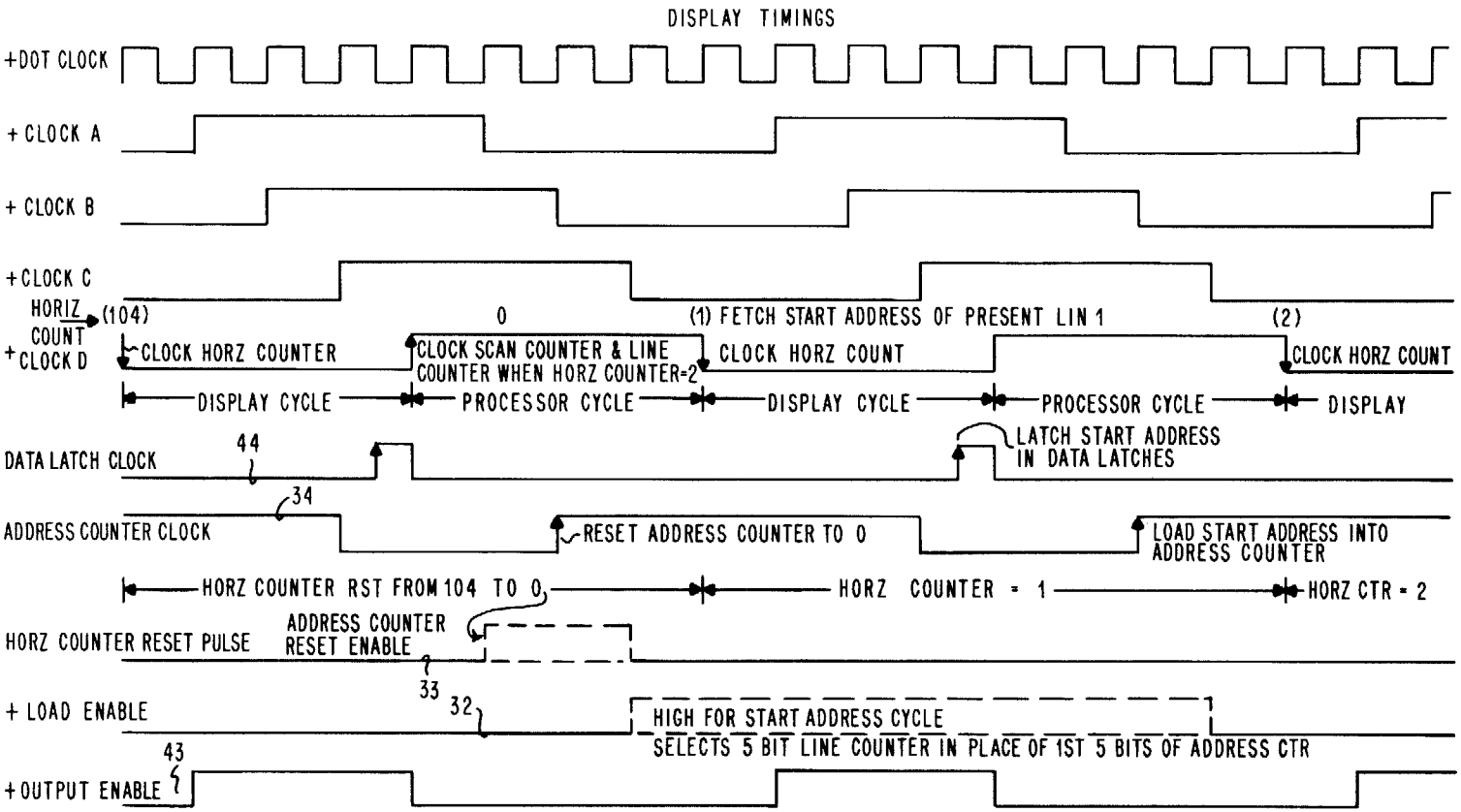
FIG. 3 are timing diagrams associated with the operation of the overall system.

For an operational description of the invention, refer to FIG. 1 and the timing diagram shown in FIG. 3 which illustrates the timing of the system. Upon initialization the processor 50 will have loaded the addresses of the first character to each of the lines to be displayed into the RAM refresh buffer 9. In the usual system the addresses would occur each 80 characters. However, as part of the flexibility of the system the processor 50 could revise the line beginnings to move lines and paragraphs of data around. This is one of the flexible aspects of the present invention. Assuming that the processor 50 has loaded the addresses of the first characters in each of the 25 lines to be displayed into the RAM refresh buffer the system now operates as follows. The dot clock provides pulses as shown in FIG. 3. As previously discussed it is simply an oscillator. The system timing is basically developed off of four subclocks, clocks A, B, C and D as shown in FIG. 3.

In operation, assume that the address counter 6 and the line counter 5 have been initialized to zero. Thus, zero inputs from lines 11 through 15 are applied to the 5 bit two to one multiplexer 7. When the load enable signal 32 is applied to the address counter 6 and to multiplexer 7 lines 11 through 15 are respectively passed along lines 20 through 24, addressing, in this case, the zero pointer in the RAM refresh buffer. This results in the reading of the address of the first character of the first line stored in the RAM refresh buffer. This address is then input along lines 27 when the output enable line 43 is brought up. As shown the output enable line 43 is brought up on the timing conditions clock A and clock D of FIG. 3. The address is therefore then applied to the inputs of latches 10. When the data clock 44 signal comes up as illustrated in FIG. 3 the data is latched into latches 10 and is applied along lines 28 to the data bus 4. This address then appears at the input to the address counter 6. At the next character clock time appearing on line 31 the contents on bus 4 are loaded into the address counter 6. Its outputs on lines 34 through 38 applied to the two to one multiplexer 7 is the address in the address counter 6 which is then applied to the RAM refresh buffer 9 when the load enable 32 is toggled low. The first character in the line is to be read from the RAM refresh buffer and applied along bus 4 to the character generator 3. This process continues as each of the clocks are applied along line 31 which step the address counter to cause it to move through the RAM refresh buffer 9 causing output characters to be passed from the RAM refresh buffer through latch 10 onto data bus 4. After a complete line of characters, e.g., 80 has been output from the RAM refresh buffer 9 the address counter 6 will be reset. This reset occurs when the horizontal counter 46 in FIG. 2 cycles past the zero position. Thus, as previously discussed, it counts from zero to 104 and back to zero. The address counter 6 then begins to count again on each clock cycle to again read the characters from the first line of data stored in RAM refresh buffer 9. This sequence of reading the complete line and resetting continues to occur for, in the present example, 8 times. At the end of 8 times the scan 8 counter 47 outputs along line 30 to cause line counter 5 to be incremented. Thus, in this example, line counter 5 will be incremented to one. This incrementing is then detected by the two to one multiplexer 7 which is then toggled when load enable 32 is high and it then applies the contents on lines 11 through 15 from the line counter to the RAM refresh buffer 9. This results in the reading of the address of the first character of the next line from RAM refresh buffer 9. This address is then, as previously described, passed through latches 10 along bus 4 into the address counter 6. This loading of this address into address counter 6 then causes the 5 bit two to one multiplexer 7 to then toggle to apply this address to the RAM refresh buffer 9. The previous sequence is then repeated to read the contents of this second line from the refresh buffer eight times and apply it to the character generator 3. The above process then continues to be repeated until all of the lines in the RAM refresh buffer have been read out eight times. After this occurs the line counter which has been incremented after each of these eight line readouts is reset to 0 when it has counted to 27 during the vertical retrace of the CRT. The line counter is at 27 when positive or one logical levels appear on lines 11, 12, 14 and 15 which are input to the timing and control 8. Thus, the decode 8*a* provides the reset signal along line 29 to line counter 5. Thus, the line counter is reset such that a new operation can be begun after 27 lines have been counted by the line counter.

In summary there is provided a display refresh system wherein a RAM refresh buffer is tightly packed. Line start addresses in the buffer are determined by the line length such as eighty characters. With each of the lines in the refresh buffer being a binary number such as 128 characters in length the line start addresses are such that they do not coincide with the beginning of each line in the buffer. To assure packing they are interspersed each 80 positions sequentially within the buffer. A processor loads the address of each line start character into the pointer area of the refresh buffer. A line counter is used which counts the lines being displayed on the display. The RAM refresh buffer which contains the line start addresses and character data is first addressed by the line counter output to provide the line address. Since the refresh buffer is used as the line pointer register the output bus for pointer data and character data is common. Once the address of the first character in a line is read from the pointer area in the refresh buffer it is entered into the refresh buffer address counter which then controls the sequential reading of characters in that line from the refresh buffer onto the data bus. Following the reading of each line the sequence is repeated, e.g., the line counter is incremented, its' count used to address the pointer register and the address contained in the pointer register loaded into the refresh buffer address counter.

With the above technique it can be seen that there is provided a system which facilitates the extremely efficient use of RAM memory. The line beginnings are not tied into any binary sequence or binary order. Instead, the line beginnings are interspersed in the RAM memory. In addition, they can be modified by the processor to provide a simplified data manipulation technique. In addition to the efficient utilization of the RAM refresh memory there has been provided a simplified technique in which the line counter counting has been tied into the pointer addressing in the RAM refresh memory. Thus, not only has the RAM refresh buffer been efficiently utilized but by storing the pointer addresses in the RAM refresh buffer and addressing it under control of the line counter, simplified logic has been provided. In addition, there has been provided a simplified communications technique since the output bus is used not only for character data, but in addition, is used for pointer data or address data.

While the invention has been particularly shown and described with reference to a particular embodiment, it will be understood by those skilled in the art that various changes in form and detail may be made without departing from the spirit and scope of the invention.

What is claimed is:

1. A display system wherein a display is refreshed by a refresh buffer containing lines of characters to be displayed comprising:

means for loading line pointers containing the address of the first character in each of said lines into a dedicated area of said refresh buffer;

a refresh buffer address counter; and a line counter having a count output equal to the number of said lines to be displayed, means for reading a line count from said line counter and means for applying each of said line counts to said refresh buffer to address the said line pointer at the corresponding address in said dedicated areas of said refresh buffer to cause reading of said first character addresses into said address counter.

2. The display system of claim 1 further wherein said lines of characters in said refresh buffer are packed end to end in said refresh buffer and said pointers in said display buffer contain the address of each of said first characters in said packed refresh buffer.

3. The display system of claim 2 further wherein said pointers in said refresh buffer are assigned addresses which correspond to said line count.

4. The display system of claim 3 further including a common bus connecting said refresh buffer, said display and said address counter whereby both address characters and characters to be displayed are applied to said common bus.

5. The display system of claim 4 further including multiplexing means for passing addresses to said refresh buffer, said multiplexing means being connected between said line counter and said address counter, and said refresh buffer.

6. The display system of claim 5 further including a control means to cause said multiplexing means to selectively pass addresses to said refresh buffer from said line counter and said address counter.

7. The display system of claim 6 further including means for incrementing said line counter following the reading of each complete line from said refresh buffer and applying the incremented count to address the next pointer in said refresh buffer to cause said address of the first character in the next line to be loaded into said address counter.

8. The display system of claim 7 further including means for toggling said multiplexer to cause it to apply the address contained in said address counter to said refresh buffer until a complete line has been read and then toggle to apply the count of said line counter to said refresh buffer to read a new character address for the next line of characters from said line pointers.

9. The display system of claim 3 further including means to cause said line counter to sequentially address said line pointers to cause sequential reading of said first character addresses from said refresh buffer.

10. The display system to claim 9 further including means for altering the addresses of said first line characters associated with said line pointers to alter the display sequence.

11. The display system of claim 10 further including means for applying each of said characters read from said refresh memory onto said common bus.

12. The display system of claim 11 further including multiplexing means for passing addresses to said refresh buffer, said multiplexing means being connected between said line counter and said address counter, and said refresh buffer.

13. The display system of claim 12 further including a control means to cause said multiplexing means to selectively pass addresses to said refresh buffer from said line counter and said address counter.

14. The display system of claim 13 further including means for incrementing said line counter following the reading of each complete line from said refresh buffer and applying the incremented count to address the next pointer in said refresh buffer to cause said address of the character in the next line to be loaded into said address counter.

15. The display system of claim 14 further including means for toggling said multiplexer to cause it to apply the address contained in said address counter to said refresh buffer until a complete line has been read and then toggle to apply the count of said line counter to said refresh buffer to read a new first character address for the next line of characters from said line pointers.

* * * * *